US007023261B2

(12) United States Patent
Mano et al.

(10) Patent No.: US 7,023,261 B2
(45) Date of Patent: Apr. 4, 2006

(54) CURRENT SWITCHING FOR MAINTAINING A CONSTANT INTERNAL VOLTAGE

(75) Inventors: Yoshitaka Mano, Kyoto (JP); George Nakane, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/750,866

(22) Filed: Jan. 5, 2004

(65) Prior Publication Data

US 2004/0135624 A1 Jul. 15, 2004

(30) Foreign Application Priority Data

Jan. 15, 2003 (JP) ..... 2003-006545

(51) Int. Cl.
*G05F 3/08* (2006.01)

(52) U.S. Cl. ..... 327/541; 327/543; 365/227

(58) Field of Classification Search ..... 327/538, 327/540, 541, 543; 365/227
See application file for complete search history.

(56) References Cited

U.S. PATENT DOCUMENTS

| | | | | |
|---|---|---|---|---|
| 5,202,838 A | | 4/1993 | Inoue | |
| 5,418,353 A | | 5/1995 | Katayama et al. | |
| 5,418,358 A | | 5/1995 | Bruhnke et al. | |
| 5,949,279 A | * | 9/1999 | Kwan | 327/545 |
| 6,343,022 B1 | | 1/2002 | Naruse | |
| 6,525,362 B1 | | 2/2003 | Sadayuki | |
| 6,768,370 B1 | * | 7/2004 | Takahashi et al. | 327/540 |
| 6,842,053 B1 | * | 1/2005 | Luo | 327/111 |

FOREIGN PATENT DOCUMENTS

| | | |
|---|---|---|
| JP | 04-032988 | 2/1992 |
| JP | 5-21738 | 1/1993 |
| JP | 10-285087 | 10/1998 |
| JP | 2001-101364 | 4/2001 |
| JP | P2002-150250 A | 5/2002 |

* cited by examiner

*Primary Examiner*—Kenneth B. Wells
*Assistant Examiner*—Terry L. Englund
(74) *Attorney, Agent, or Firm*—McDermott Will & Emery LLP

(57) ABSTRACT

A semiconductor memory device includes a voltage reduction circuit which reduces a power supply voltage and outputs an internal voltage, a nonvolatile memory connected to the internal voltage and a current consumption control circuit including a switch transistor and a resistor. In this case, the amount of electric current which the nonvolatile memory consumes and the amount of electric current which the resistor consumes are substantially the same. When the nonvolatile memory is in a non-operation state, the current consumption control circuit turns ON the switch transistor by a memory activation signal and consumes substantially the same amount of electric current as the amount of electric current which the nonvolatile memory consumes. When the nonvolatile memory is in an operation state, the current consumption control circuit turns OFF the switch transistor and stops electric current consumption by the resistor.

11 Claims, 9 Drawing Sheets

CURRENT SWITCHING FOR MAINTAINING A CONSTANT INTERNAL VOLTAGE

BACKGROUND OF THE INVENTION

The present invention relates to a semiconductor device and an IC card including a semiconductor device, and particularly relates to a semiconductor device including a memory circuit and a voltage supply circuit for supplying a predetermined voltage to the memory circuit, and an IC card including the semiconductor device.

With the recent progress in the semiconductor processing technology, the size of elements of constituting a semiconductor device is reduced and at the same time, the operation voltage of semiconductor devices is reduced. When a chip part formed by the recent processing technology is used for a known electric device, an internal voltage generated by reducing a power supply voltage for the electric device is used in the chip part.

More specifically, in recent years, as for IC cards including a semiconductor memory device, a non-contact IC card which receives by an antenna coil an electromagnetic wave supplied from the outside of the IC card to obtain a power supply voltage has been developed. In such an IC card, it is necessary to supply a stable internal voltage to a nonvolatile memory without depending on a variation in a voltage supplied from the outside. Hereinafter, as a first known example, a semiconductor memory device using a voltage reduction circuit for reducing a power supply voltage to generate an internal voltage will be described.

FIG. 8 is a block diagram illustrating the configuration of a semiconductor memory device according to a first known example. As shown in FIG. 8, a power supply voltage $V_{DD}$ input into a power supply terminal is reduced by a voltage reduction circuit 101 and then supplied as an internal voltage $V_{INT}$ to a logic circuit 102 and a nonvolatile memory 103. When a nonvolatile driving signal NCE output from the logic circuit 102 is the "L" level, the nonvolatile memory 103 is activated to start an operation.

In this case, the voltage reduction circuit 101 includes a p-channel output transistor $Q_{P11}$ having a gate connected to an output terminal of a differential amplifier circuit 111, and the power supply voltage $V_{DD}$ input from the power supply terminal is reduced by the output transistor $Q_{P11}$ to be an internal voltage $V_{INT}$ having a lower potential than that of the power supply voltage $V_{DD}$.

One input terminal of the differential amplifier circuit 111 is connected to a reference potential generator circuit 112 for generating a reference potential $V_{REF}$ and the other input terminal thereof is connected to a voltage divider circuit 113 for generating an intermediate potential $V_{MID}$ between the internal voltage $V_{INT}$ and a ground voltage $V_{SS}$ so that an output potential $V_{ADJ}$ according to a potential difference ($V_{MID}-V_{REF}$) between the intermediate potential $V_{MID}$ and the reference potential $V_{REF}$ is output. More specifically, when the intermediate potential $V_{MID}$ is higher than the reference potential $V_{REF}$, the output potential $V_{ADJ}$ makes a transition toward the "H" level, and when the intermediate potential $V_{MID}$ is lower than the reference potential $V_{REF}$, the output potential $V_{ADJ}$ makes a transition toward the "L" level.

The voltage divider circuit 113 includes two resistors $R_{11}$ and $R_{12}$ connected in series to each other. One terminal of the voltage divider circuit 113 is connected to the drain of the output transistor $Q_{P11}$ and the other terminal is grounded. Moreover, a connection node of the resistors $R_{11}$ and $R_{12}$ is connected to an input terminal of the differential amplifier circuit 111. In this case, the voltage divider circuit 113 outputs the intermediate potential $V_{MID}$, i.e., a voltage obtained by dividing the internal voltage $V_{INT}$ according to the ratio between respective resistance values of the resistors $R_1$ and $R_2$.

Thus, when the internal voltage $V_{INT}$ is reduced, the intermediate potential $V_{MID}$ becomes lower than the reference potential $V_{REF}$ and then the output voltage $V_{ADJ}$ in the differential amplifier circuit 111 makes a transition toward the "L" level. Accordingly, the carrier supply amount of the output transistor $Q_{P11}$ is increased, so that reduction in the potential of the internal voltage $V_{INT}$ is suppressed. On the other hand, when the internal voltage $V_{INT}$ is increased, the intermediate potential $V_{MID}$ becomes higher than the reference potential $V_{REF}$ and then the output voltage $V_{ADJ}$ in the differential amplifier circuit 111 makes a transition toward the "H" level. Accordingly, the carrier supply amount of the output transistor $Q_{P11}$ is reduced, so that increase in the potential of the internal voltage $V_{INT}$ is suppressed.

In this manner, the voltage reduction circuit 101 controls the output transistor $Q_{P11}$ using the differential amplifier circuit 111, so that change in the potential of the internal voltage $V_{INT}$ is suppressed, the internal voltage $V_{INT}$ as a stabilized voltage is generated from the power supply voltage $V_{DD}$, and then the generated internal voltage $V_{INT}$ is supplied to the nonvolatile memory 103 serving as an internal circuit.

Moreover, in recent years, a semiconductor memory device in which a control circuit for receiving a control signal of the nonvolatile memory 103 to control the operation of the voltage reduction circuit 101 is provided to suppress reduction in the potential of the internal voltage $V_{INT}$ due to the operation of the nonvolatile memory 103 has been developed (see, e.g., Japanese Unexamined Patent Publication No. 5-21738). Hereinafter, as a second known example, the semiconductor memory device described in the publication will be described.

FIG. 9 is a block diagram illustrating the configuration of a semiconductor memory device according to a second known example. In FIG. 9, each member also shown in FIG. 8 is identified by the same reference numeral, and therefore, description thereof will be omitted.

As shown in FIG. 9, in the semiconductor memory device of the second known example, a p-channel compensating transistor $Q_{P12}$ which receives a control signal output by the control circuit 104 at the gate and of which source and drain are connected to the source and drain of the output transistor $Q_{P11}$, respectively, is provided.

To the control circuit 104, a nonvolatile memory driving signal NCE is input from the logic circuit 102. In this case, when the nonvolatile memory driving signal NCE makes a transition from the "H" level to the "L" level, the control circuit 104 is output the ground potential $V_{SS}$ during a predetermined period.

In the semiconductor memory device of the second known example, when a non-operation state of the nonvolatile memory 103 is changed to an operation state and the compensating transistor $Q_{P12}$ is turned ON, carriers are supplied from the power supply voltage $V_{DD}$ to the internal voltage $V_{INT}$ through the compensating transistor $Q_{P12}$. Thus, reduction in the potential of the internal voltage $V_{INT}$ is suppressed.

However, in the semiconductor memory device of the first known example, the internal voltage $V_{INT}$ rapidly falls when the nonvolatile memory 103 is in an operation state. Therefore, a problem might arise in operations of the logic circuit 102 and the nonvolatile memory 103.

Particularly, when the semiconductor memory device of the first known example is used for a non-contact IC card, a rapid fall of the internal voltage $V_{INT}$ stops the operation of the nonvolatile memory 103. More specifically, in the non-contact IC card, a power supply voltage $V_{DD}$ is supplied to a semiconductor device in the IC card by radio communication with a terminal called "reader/writer". A voltage level of the power supply voltage $V_{DD}$ is largely changed according to a distance between the IC card and the reader/writer. Therefore, in many cases, a semiconductor memory device loaded in a non-contact IC card is so configured that when the internal voltage $V_{INT}$ becomes equal to or lower than a predetermined level by change in the power supply voltage $V_{DD}$, the circuit operation of the nonvolatile memory 103 is stopped to protect data. Accordingly, a problem arises in which the operation of the nonvolatile memory is stopped when the internal voltage $V_{INT}$ rapidly falls.

To cope with this problem, in some cases, a capacitor with a large capacity is provided between the internal voltage $V_{INT}$ and the ground potential $V_{SS}$. However, with this structure, a large area is necessary for forming a capacitor. Accordingly, reduction in a layout area for the semiconductor memory device becomes difficult.

Moreover, in the semiconductor memory device of the second known example, when the compensating transistor $Q_{P12}$ is turned ON, the power supply voltage $V_{DD}$ and the internal voltage $V_{INT}$ are directly connected to each other. Thus, an excess voltage might be applied to the nonvolatile memory 103. Therefore, the semiconductor memory device of the second known example is not practical in terms of reliability.

In this manner, both of the semiconductor memory devices of the first and second known examples have a problem in which when a non-operation state of the nonvolatile memory is changed to an operation state, it is difficult to suppress a rapid fall of the internal voltage.

SUMMARY OF THE INVENTION

It is an object of the present invention to solve the above-described problem and to allow a stable voltage supply, even when a non-operation state of the internal circuit is changed to an operation state, in a semiconductor device in which a predetermined voltage is supplied to an internal circuit.

To achieve the object, according to the present invention, a load circuit which consumes the same amount of electric current as the amount of electric current which an internal circuit consumes is provided in a semiconductor device and the internal circuit and the load circuit are alternately operated.

More specifically, a semiconductor device according to the present invention includes: an internal voltage supply circuit for generating an internal voltage from a power supply voltage; an internal circuit which is operated by the internal voltage; a switching transistor for receiving at a gate an operation signal output from the internal circuit; and a load circuit which is connected to a drain of the switching transistor and consumes the same amount of electric current as the amount of electric current which the internal circuit consumes during an operation period, and by the operation signal, the switch transistor is turned OFF when the internal circuit is in an operation state and is turned ON when the internal circuit is in a non-operation state.

In the semiconductor device of the present invention, the load circuit consumes the same amount of electric current as the amount of electric current which the internal circuit consumes when the internal circuit is in a non-operation state and the load circuit does not consume electric current when the internal circuit is in an operation state. Thus, even when a non-operation state of the internal circuit is changed to an operation state, the amount of electric current consumption of the internal voltage is not changed, so that the internal voltage can be stabilized.

It is preferable that in the semiconductor device of the present invention, the load circuit includes a first resistor. Thus, by adjusting the resistance value of the first resistor, the amount of electric current consumption in the load circuit can be adjusted.

It is preferable that in the semiconductor device of the present invention, the amount of electric current which the first resistor consumes is substantially the same as the amount of electric current which the internal circuit consumes during an operation period.

It is preferable that in the semiconductor device of the preset invention, the load circuit includes a load adjustment section connected in series to the first resistor. Thus, by adjusting a load of the load adjustment section, the amount of electric current consumption in the load circuit can be adjusted. Accordingly, even when the amount of electric current consumption in the internal circuit varies among semiconductor device, the amount of electric current of the load circuit can be adjusted so that the load circuit consumes the same amount of electric current as the amount of electric current which the internal circuit consumes in an operation period.

It is preferable that in the semiconductor device, the amount of electric current which the first resistor and the load adjustment section consume is the substantially the same as the amount of electric current which the internal circuit consumes during an operation period.

It is preferable that in the semiconductor device, the load adjustment section includes a second resistor and a fuse device connected in parallel to each other. Thus, by cutting the fuse device, an adjustment can be reliably made so that the amount of electric current which the first resistor and the load adjustment section consume is the same amount of electric current which the internal circuit consumes during an operation period.

It is preferable, that in the semiconductor device of the present invention, the load adjustment section includes a second resistor and a transistor connected in parallel to each other. Thus, by controlling the transistor, an adjustment can be reliably made so that the amount of electric current which the first resistor and the load adjustment section consume is the same as the amount of electric current which the internal circuit consumes during an operation period.

It is preferable that the semiconductor device of the present invention further includes a latch circuit connected to the transistor. Thus, the transistor can be controlled based on data stored in the latch circuit.

It is preferable that in the semiconductor device of the present invention, the switch transistor is an n-channel transistor.

It is preferable that in the semiconductor device of the present invention, the switching transistor has a source grounded and a drain connected to the internal voltage supply circuit via the load circuit.

It is preferable that in the semiconductor device of the present invention, the switch transistor is a p-channel transistor.

It is preferable that in the semiconductor device of the present invention, the switch transistor has a source connected to the internal voltage supply circuit and a drain grounded via the load circuit.

An IC card according to the present invention includes the semiconductor device of the present invention.

In the IC card of the present invention, the load circuit in the semiconductor device loaded in the IC card consumes the same amount of electric current as the amount of electric current which the internal circuit consumes when the internal circuit is in a non-operation state and the load circuit does not consume electric current when the internal circuit is in an operation state. Thus, even when a non-operation state of the internal voltage is changed to an operation state, the amount of electric current consumption of the internal voltage is not changed, so that the internal voltage can be stabilized. Moreover, the internal voltage is stabilized without using a capacitor with a large capacity. Thus, a highly reliable IC card in which an internal voltage is stabilized without increasing the layout area for the semiconductor device can be obtained.

DESCRIPTION OF THE PREFERRED EMBODIMENTS (First Embodiment)

A semiconductor memory device according to a first embodiment of the present invention will be described with reference to the accompanying drawings.

Figure 1:
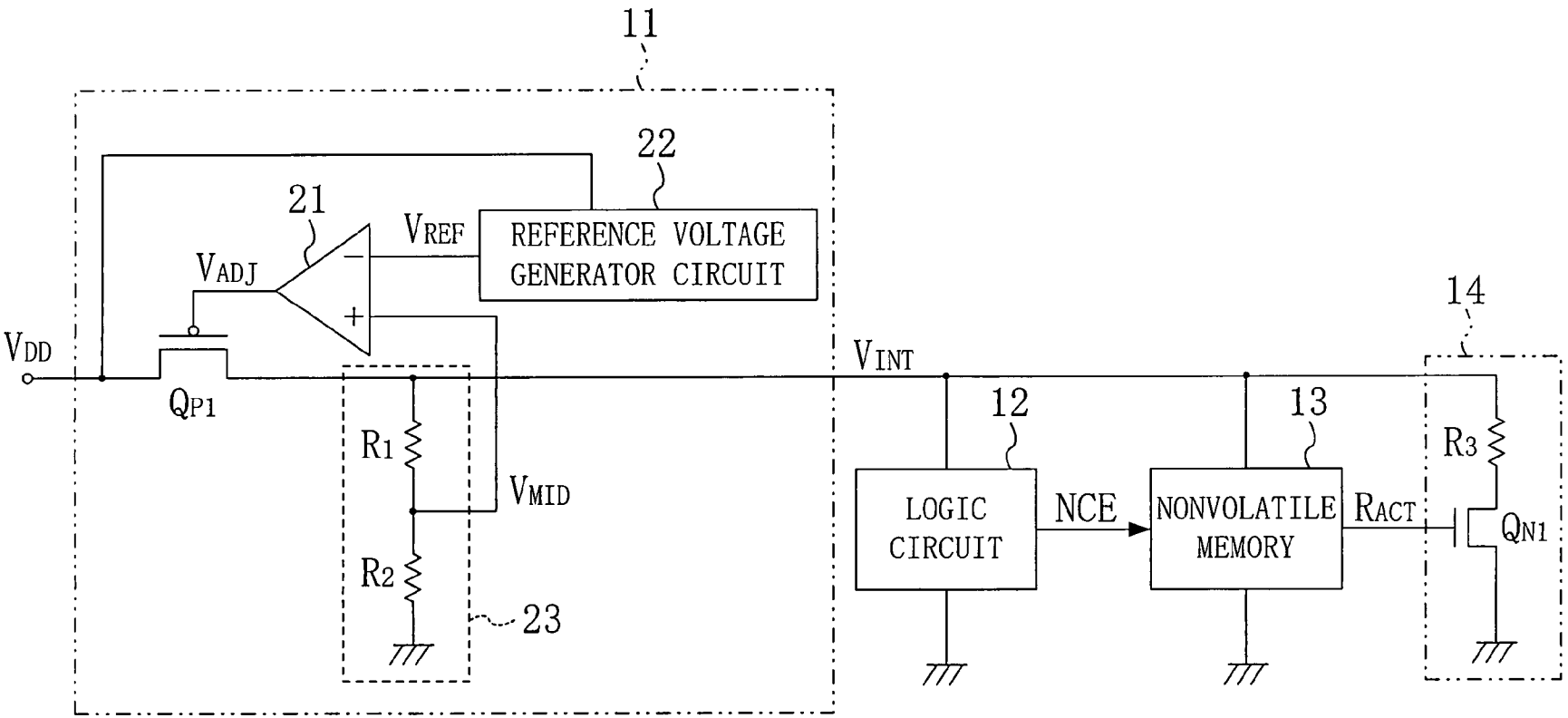
FIG. 1 is a block diagram illustrating the configuration of a semiconductor memory device according to a first embodiment of the present invention.

FIG. 1 is a block diagram illustrating the configuration of a semiconductor memory device according to the first embodiment. As shown in FIG. 1, the semiconductor memory device of the first embodiment includes a voltage reduction circuit 11 for reducing a power supply voltage $V_{DD}$ input from an input terminal to generate an internal voltage $V_{INT}$ having a lower potential than that of the power supply voltage, a logic circuit 12 and a nonvolatile memory 13 which are operated by the internal voltage $V_{INT}$, and an current consumption control circuit 14 which is operated according to a memory activation signal $R_{ACT}$ from the nonvolatile memory.

The voltage reduction circuit 11 includes a p-channel output transistor $Q_{P1}$ in which a power supply voltage $V_{DD}$ is applied to a source and an internal voltage $V_{INT}$ is output at a drain, a differential amplifier circuit 21 for outputting an output voltage $V_{ADJ}$ according to a potential difference between two input terminals to the gate of the output transistor $Q_{P1}$, a reference voltage generation circuit 22 for inputting a reference potential $V_{REF}$ to one input terminal of the differential amplifier circuit 21, and a voltage divider circuit 23 for inputting an intermediate potential $V_{MID}$ to the other input terminal of the differential amplifier circuit 21. The power supply voltage $V_{DD}$ input into the voltage reduction circuit 11 is reduced by a constant level by a source-drain resistance in the output transistor $Q_{P1}$ and then is output as the internal voltage $V_{INT}$.

The differential amplifier circuit 21 outputs an output potential $V_{ADJ}$ according to a potential difference ($V_{MID}-V_{REF}$) between the intermediate potential $V_{MID}$ and the reference potential $V_{REF}$. More specifically, when the intermediate potential $V_{MID}$ is higher than the reference potential $V_{REF}$, the output potential $V_{ADJ}$ makes a transition toward the "H" level, and when the intermediate potential $V_{MID}$ is lower than the reference potential $V_{REF}$, the output potential $V_{ADJ}$ makes a transition toward the "L" level.

The reference voltage generator circuit 22 includes, for example, a plurality of resistance elements and a diode connected in series between the power supply voltage $V_{DD}$ and the ground potential $V_{SS}$. When the power supply voltage $V_{DD}$ is equal to or higher than a predetermined potential, the reference potential $V_{REF}$, i.e., a substantially constant potential, is output without depending on the power supply voltage $V_{DD}$.

The voltage divider circuit 23 includes two resistors $R_1$ and $R_2$ connected in series to each other. One terminal of the voltage divider circuit 23 is connected to the drain of the output transistor $Q_{P1}$ and the other terminal is grounded. Moreover, a connection node of the resistors $R_1$ and $R_2$ is connected to an input terminal of the differential amplifier circuit 21.

In this case, when resistance values of the resistors $R_1$ and $R_2$ are assumed to be $r_1$ and $r_2$, respectively, a value for the intermediate potential $V_{MID}$ output by the voltage divider circuit 23 can be expressed as the following Equation 1.

$$V_{MID}=r_2/(r_1+r_2)\cdot V_{INT} \quad \text{[Equation 1]}$$

As shown in Equation 1, the intermediate potential $V_{MID}$ is a value obtained by dividing the internal voltage $V_{INT}$ according to the ratio of the resistance values of the resistors $R_1$ and $R_2$.

Thus, when the internal voltage $V_{INT}$ is reduced, the intermediate potential $V_{MID}$ becomes lower than the reference potential $V_{REF}$ and then the output voltage $V_{ADJ}$ in the differential amplifier 111 makes a transition toward the "L" level. Accordingly, a carrier supply amount in the output transistor $Q_{P1}$ is increased, so that reduction in the potential of the internal voltage $V_{INT}$ is suppressed.

On the other hand, when the internal voltage $V_{INT}$ is increased, the intermediate potential $V_{MID}$ becomes higher than the reference potential $V_{REF}$ and then the output voltage $V_{ADJ}$ in the differential amplifier 111 makes a transition toward the "H" level. Accordingly, the carrier supply amount in the output transistor $Q_{P1}$ is reduced, so that increase in the potential of the internal voltage $V_{INT}$ is suppressed.

In this manner, the voltage reduction circuit 11 functions as an internal voltage supply circuit which controls the output transistor $Q_{P1}$ by the differential amplifier circuit 21 to generate, from the power supply voltage $V_{DD}$, the internal voltage $V_{INT}$ as a stabilized voltage and then supplies the obtained internal voltage $V_{INT}$ to the nonvolatile memory 13 serving as an internal circuit.

Note that in the first embodiment, a circuit for supplying the internal voltage $V_{INT}$ is not limited to the voltage reduction circuit 11 but may be any other circuit which can supply a stabilized internal voltage $V_{INT}$ to the nonvolatile memory 13. For example, a booster circuit may be used.

The logic circuit 12 is a circuit for controlling the operation of the nonvolatile memory 13 and outputs a nonvolatile memory driving signal NCE as a signal for driving the nonvolatile memory 13. The nonvolatile memory driving signal NCE is the "H" level in an initial state. The nonvolatile memory 13 detects a transition of the nonvolatile memory driving signal NCE from the "H" level to the "L" level, thereby equalizing off a bit line, driving a word line, performing a series of a read operation such as sense amplifying, and an erase or rewrite operation.

The nonvolatile memory 13 includes a memory cell array includes, for example, ferroelectric memory cells and a memory control section for controlling a predetermined operation such as a read operation, an erase or rewrite operation with respect to the memory cell array. In the nonvolatile memory 13, a memory activation signal $R_{ACT}$ which is one of signals for controlling an operation with respect to a memory cell array is the "H" level in an initial state. The memory activation signal $R_{ACT}$ is the "L" level during a period from a fall of the nonvolatile memory cell driving signal NCE to completion of a series of a read, erase or rewrite operation is completed.

The current consumption control circuit 14 includes an n-channel switch transistor $Q_{N1}$ which receives the memory activation signal $R_{ACT}$ from the nonvolatile memory 13 at the gate and of which source is grounded, and a resistor $R_3$ of which one terminal is connected to the drain of the switch transistor $Q_{N1}$ and the other terminal is connected to the internal voltage $V_{INT}$.

A resistance value of the resistor $R_3$ is set so that the amount of electric current which the resistor $R_3$ consumes per unit time is substantially the same as the amount of electric current which the nonvolatile memory 13 consumes per unit time in an operation state. More specifically, for example, by simulating circuit properties in design in the nonvolatile memory 13, the amount of electric current consumption of the nonvolatile memory 13 can be obtained. Accordingly, the amount of electric current consumption of the nonvolatile memory 13 and the resistance value of the resistor $R_3$ can be set.

In this case, while the nonvolatile memory 13 is operated, the memory activation signal $R_{ACT}$ is the "L" level and the switch transistor $Q_{N1}$ is in an OFF state. Thus, an electric current is not consumed in the current consumption control circuit 14.

On the other hand, while the nonvolatile memory 13 is not operated, the memory activation signal $R_{ACT}$ is the "H" level and then the switch transistor $Q_{N1}$ is in an ON state. Thus, the internal voltage $V_{INT}$ flows into the ground via the switch transistor $Q_{N1}$. In this case, the resistor $R_3$ serves as a load circuit which consumes an equivalent electric current to the amount of electric current which the nonvolatile memory 13 consumes.

Accordingly, when the nonvolatile memory 13 is in an operation state, the current consumption control circuit 14 is stopped and the nonvolatile memory 13 consumes a predetermined amount of electric current. When the nonvolatile memory 13 is in a non-operation state, the current consumption circuit 14 is operated and consumes substantially the same amount of electric current as the amount of electric current the nonvolatile memory 13 consumes. Thus, the same amount of electric current is consumed when the nonvolatile memory 13 is in a non-operation state and when the nonvolatile memory 13 is in an operation state.

As has been described, in the semiconductor memory device of the first embodiment, the potential of the internal voltage $V_{INT}$ is not reduced when an non-operation state of the nonvolatile memory 13 is changed to an operation state, so that the internal voltage $V_{INT}$ is stabilized.

(Second Embodiment)

Hereinafter, a semiconductor memory device according to a second embodiment of the present invention will be described with the accompanying drawings.

Figure 2:
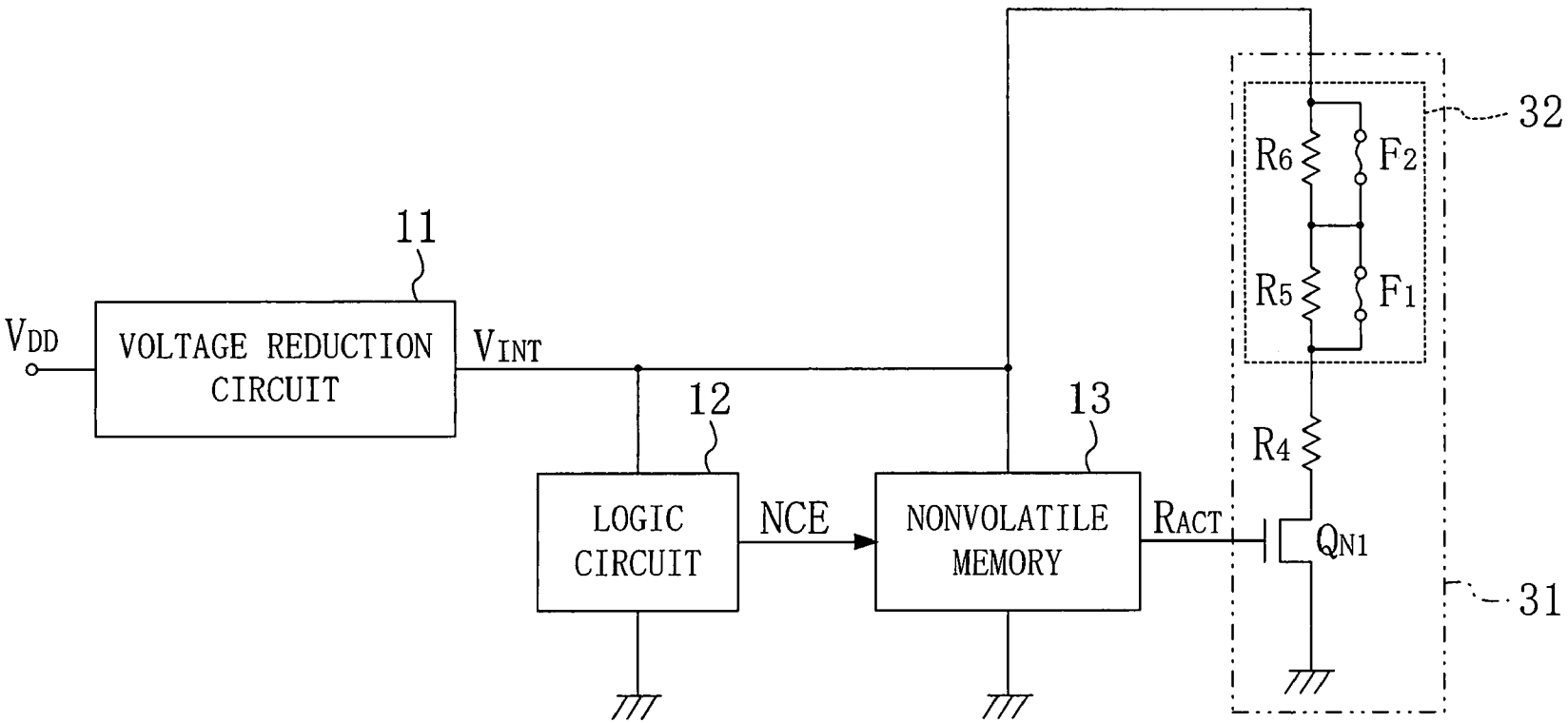
FIG. 2 is a block diagram illustrating the configuration of a semiconductor memory device according to a second embodiment of the present invention.

FIG. 2 is a block diagram illustrating the configuration of a semiconductor memory device according to the second embodiment. In FIG. 2, each member also shown in FIG. 1 is identified by the same reference numeral, and therefore, description thereof will be omitted.

As shown in FIG. 2, in the semiconductor memory device of the second embodiment, a current consumption control circuit 31 has a different configuration from that of the current consumption control circuit of the first embodiment and each of a voltage reduction circuit 11, a logic circuit 12 and a nonvolatile memory 13 has the same configuration as that of the first embodiment.

In the current consumption circuit 31 of the second embodiment, a switch transistor $Q_{N1}$, a resistor $R_4$, and a load adjustment section 32 including resistors $R_5$ and $R_6$ connected in series to each other and fuses $F_1$ and $F_2$ connected in parallel to the resistors $R_5$ and $R_6$, respectively, are connected in series. In this case, each of the fuses $F_1$ and $F_2$ is formed as a fuse which can be cut from the outside of the semiconductor memory device.

The switch transistor $Q_{N1}$ receives a memory activation signal $R_{ACT}$ from the nonvolatile memory 13 at the gate and the source of the switch transistor $Q_{N1}$ is grounded. In the resistor $R_4$, one terminal is connected to the drain of the switch transistor $Q_{N1}$ and the other terminal is connected to a common terminal shared by the resistor $R_5$ and the fuse $F_1$. Moreover, a common terminal shared by the resistor $R_6$ and the fuse $F_2$ is connected to the internal voltage $V_{INT}$.

A resistance value of the resistor $R_4$ is set so that the amount of electric current which the resistor $R_4$ consumes per unit time is slightly larger than the amount of electric current which the nonvolatile memory 13 consumes per unit time in an operation state. More specifically, for example, by simulating circuit properties in design in the nonvolatile memory 13, the amount of electric current consumption of the nonvolatile memory 13 can be obtained and then the resistance value of the resistor $R_4$ can be set from the obtained amount of electric current consumption.

The load adjustment section 32 adjusts a load of the current consumption control circuit 31 so that the amount of electric current which the current consumption control circuit 31 is substantially the same as the amount of electric current which the nonvolatile memory 13 consumes. More specifically, after a value for electric current consumed in the nonvolatile memory has been actually measured, one or both of the fuses $F_1$ and $F_2$ are cut so that the measured electric current value and the amount of electric current consumed in the resistor $R_4$ and the load adjustment section 32 are the same. Thus, the resistor $R_4$ and the load adjustment section 32 can be used as a load circuit which consumes substantially the same amount of electric current as the amount of electric current consumption of the nonvolatile memory 13.

The amount of electric current consumption of the nonvolatile memory 13 is different among chips due to variations in fabrication process steps and variations in a wafer surface. Therefore, by adjusting the resistance value of the load adjustment section 32, the amount of electric current consumed in the resistor $R_4$ and the load adjustment section 32 can be adjusted according to the amount of electric current consumption of each chip.

Note that in the second embodiment, the load adjustment section 32 includes two parallel circuits in which a resistor and a fuse are connected in parallel to each other. However, the number of parallel circuits in which a resistor and a fuse are connected in parallel to each other is not limited to two. If more circuits in which a resistor and a fuse are connected in parallel to each other are provided, a more detail setting becomes possible. Accordingly, the amount of electric current consumed in the resistor $R_4$ and the load adjustment section 32 can be more reliably adjusted.

Moreover, the configuration of the load adjustment section 32 is not limited to the configuration in which the resistor $R_4$ and the load adjustment section 32 are connected to the drain side of the switch transistor $Q_{N1}$ in this order, but the load adjustment section 32 may have some other configuration as long as each of the resistor $R_4$ and the load adjustment section 32 is connected in series to the switch transistor.

As has been described, according to the second embodiment, an adjustment can be reliably made so that the amount of electric current which the current consumption control circuit 31 consumes in an operation state is the same as the amount of electric current which the nonvolatile memory 13 consumes in an operation state.

(Third Embodiment)

Hereinafter, a semiconductor memory device according to a third embodiment of the present invention will be described with reference to the accompanying drawings.

Figure 3:
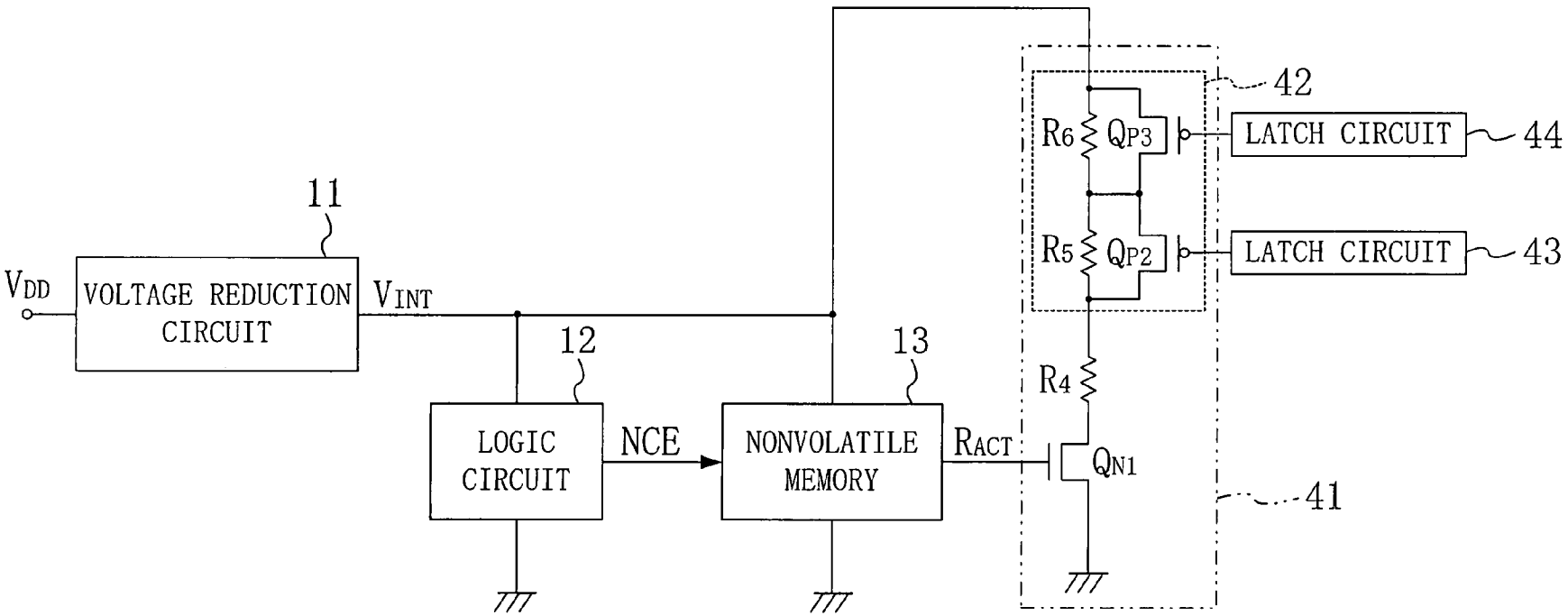
FIG. 3 is a block diagram illustrating the configuration of a semiconductor memory device according to a third embodiment of the present invention.

FIG. 3 is a block diagram illustrating the configuration of a semiconductor memory device according to the third embodiment. In FIG. 3, each member also shown in FIGS. 1 and 2 is identified by the same reference numeral, and therefore, description thereof will be omitted.

As shown in FIG. 3, in the semiconductor memory device of the third embodiment, a current consumption control circuit 41 has a different configuration from that of the current consumption control circuit of the first embodiment and each of a voltage reduction circuit 11, a logic circuit 12 and a nonvolatile memory 13 has the same configuration as that of the first embodiment.

In the current consumption circuit 41 of the third embodiment, a switch transistor $Q_{N1}$, a resistor $R_4$ and a load adjustment section 42 including resistors $R_5$ and $R_6$ connected in series to each other and p-channel transistors $Q_{P2}$ and $Q_{P3}$ connected in parallel to the resistors $R_5$ and $R_6$, respectively, are connected in series. Moreover, latch circuits 43 and 44 for storing a predetermined data are connected to the p-channel transistors $Q_{P2}$ and $Q_{P3}$, respectively.

The switch transistor $Q_{N1}$ receives a memory activation signal $R_{ACT}$ from the nonvolatile memory 13 at the gate and the source of the switch transistor $Q_{N1}$ is grounded. In the resistor $R_4$, one terminal is connected to the drain of the switch transistor $Q_{N1}$ and the other terminal is connected to a common terminal shared by the resistor $R_5$ and the p-channel transistor $Q_{P2}$. Moreover, a common terminal shared by the resistor $R_6$ and the p-channel transistor $Q_{P3}$ is connected to the internal voltage $V_{INT}$.

A resistance value of the resistor $R_4$ is set so that the amount of electric current which the resistor $R_4$ consumes per unit time is slightly larger than the amount of electric current which the nonvolatile memory 13 consumes per unit time in an operation state. More specifically, for example, by simulating circuit properties in design in the nonvolatile memory 13, the amount of electric current consumption of the nonvolatile memory 13 can be obtained and the resistance value of the resistor $R_4$ can be set from the obtained amount of electric current consumption.

The load adjustment section 42 adjusts a load of the current consumption control circuit 41 so that the amount of electric current which the current consumption control circuit 41 consumes is substantially the same as the amount of electric current which the nonvolatile memory 13 consumes.

More specifically, after a value for electric current consumed in the nonvolatile memory has been actually measured, necessary correction data is first written in a predetermined region of the nonvolatile memory 13 in advance, based on the measured electric current value, so that the amount of electric current consumption of the nonvolatile memory 13 substantially corresponds to the amount of electric current consumed in the resistor $R_4$ and the load adjustment section 42.

Next, after a power supply has been input to the semiconductor memory device, the correction data from the nonvolatile memory 13 is stored in the latch circuits 43 and 44. Thus, based on the data stored in the latch circuits 43 and 44, one or both of the p-channel transistors $Q_{P2}$ and $Q_{P3}$ are cut, so that the resistance value of the load adjustment section is 42 is adjusted. Therefore, the resistor $R_4$ and the load adjustment section 42 can be used as a load circuit which consumes substantially the same amount of electric current as the amount of electric current consumption of the nonvolatile memory 13.

The amount of electric current consumption of the nonvolatile memory 13 is different among chips due to variations in fabrication process steps and variations in a wafer surface. Therefore, by adjusting the resistance value of the load adjustment section 42, the amount of electric current consumed in the resistor $R_4$ and the load adjustment section 42 can be adjusted according to the current consumption amount of each chip.

Note that in the third embodiment, the load adjustment section 42 includes two parallel circuits in which a resistor and a p-channel transistor are connected in parallel to each other. However, the number of parallel circuits in which a resistor and a p-channel transistor are connected in parallel to each other is not limited to two. If more circuits in which a resistor and a p-channel transistor are connected in parallel to each other are provided, a more detail setting becomes possible. Accordingly, the amount of electric current consumed in the resistor $R_4$ and the load adjustment section 42 can be more reliably adjusted.

Moreover, the configuration of the load adjustment section 42 is not limited to the configuration in which the resistor $R_4$ and the load adjustment section 42 are connected to the drain side of the switch transistor $Q_{N1}$ in this order, but the load adjustment section 42 may have some other configuration, as long as the resistor $R_4$ and the load adjustment section 42 are connected to the switch transistor in series.

As has been described, according to the third embodiment, an adjustment can be reliably made so that the amount of electric current which the current consumption control circuit 41 consumes in an operation state is the same as the amount of electric current which the nonvolatile memory 13 consumes in an operation state.

(Fourth Embodiment)

Hereinafter, a semiconductor memory device according to a fourth embodiment of the present invention will be described with reference to the accompanying drawings.

Figure 4:
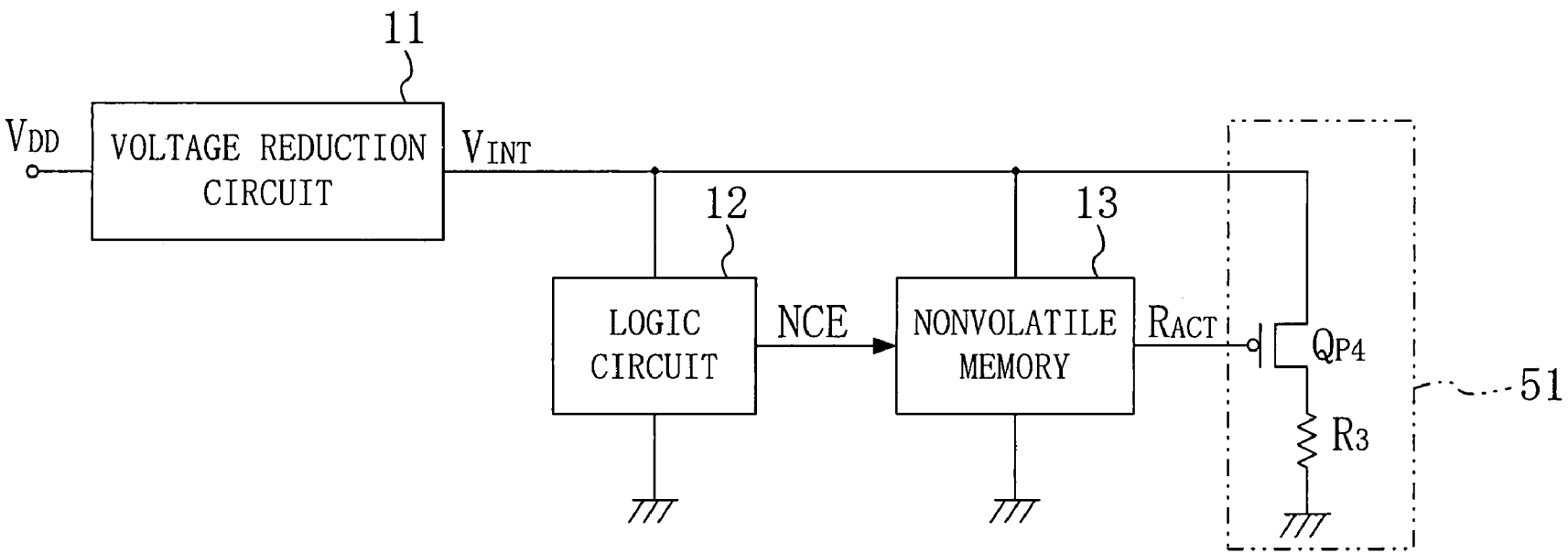
FIG. 4 is a block diagram illustrating the configuration of a semiconductor memory device according to a fourth embodiment of the present invention.

FIG. 4 is a block diagram illustrating the configuration of a semiconductor memory device according to the fourth embodiment. In FIG. 4, each member also shown in FIG. 1 is identified by the same reference numeral, and therefore, description thereof will be omitted.

As shown in FIG. 4, in the semiconductor memory device of the fourth embodiment, a current consumption control circuit 51 has a different configuration from that of the current consumption control circuit of the first embodiment. The current consumption control circuit 51 receives the memory activation signal $R_{ACT}$ from the nonvolatile memory 13 at the gate and includes a p-channel switch transistor $Q_{P4}$ of which source is connected to the internal voltage $V_{INT}$ and a resistor $R_3$ of which one terminal is connected to the drain of the switch transistor $Q_{P4}$ and the other terminal is grounded.

A resistance value of the resistor $R_3$ is set so that the amount of electric current which the resistor $R_3$ consumes for unit hour substantially corresponds to the amount of electric current which the nonvolatile memory 13 consumes per unit time in an operation state.

In the fourth embodiment, a memory activation signal $R_{ACT}$ output from the nonvolatile memory 13 is the "L" level in an initial state. The memory activation signal $R_{ACT}$ is the "H" level during a period from a rise of the nonvolatile memory driving signal NCE to completion of a series of a read, erase or rewrite operation.

Accordingly, while the nonvolatile memory 13 is operated, the memory activation signal $R_{ACT}$ is the "H" level and the switch transistor $Q_{P4}$ is in an OFF state. Thus, an electric current is not consumed in the current consumption control circuit 51.

On the other hand, while the nonvolatile memory 13 is not operated, the memory activation signal $R_{ACT}$ is the "L" level and then the switch transistor $Q_{P4}$ is in an ON state. Thus, the internal voltage $V_{INT}$ flows into the ground via the switch transistor $Q_{P4}$, so that the resistor $R_3$ consumes an amount of electric current which substantially corresponds to the amount of electric current which the nonvolatile memory 13 consumes.

(Fifth Embodiment)

Hereinafter, a semiconductor memory device according to a fifth embodiment of the present invention will be described with reference to the accompanying drawings.

Figure 5:
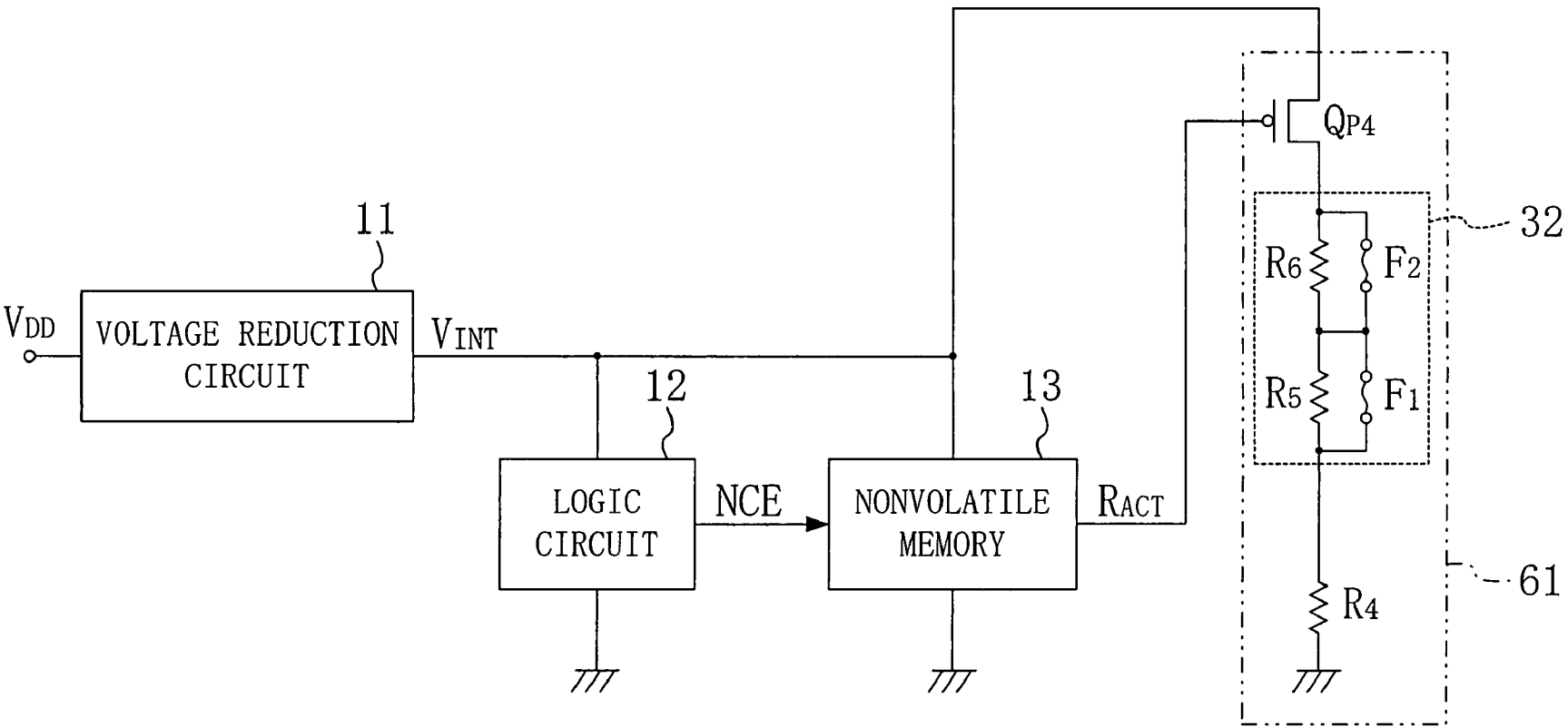
FIG. 5 is a block diagram illustrating the configuration of a semiconductor memory device according to a fifth embodiment of the present invention.

FIG. 5 is a block diagram illustrating the configuration of a semiconductor memory device according to the fifth embodiment. In FIG. 5, each member also shown in FIGS. 2 and 4 is identified by the same reference numeral, and therefore, description thereof will be omitted.

As shown in FIG. 5, in a current consumption control circuit 61 of the fifth embodiment, a switch transistor $Q_{P4}$, a resistor $R_4$, and a load adjustment section 32 including resistors $R_5$ and $R_6$ connected in series to each other and fuses $F_1$ and $F_2$ connected in parallel to the resistors $R_5$ and $R_6$, respectively, are connected in series. In this case, each of the fuses $F_1$ and $F_2$ is formed as a fuse which can be cut from the outside of the semiconductor memory device.

In this case, as in the fourth embodiment, while the nonvolatile memory 13 is operated, the memory activation signal $R_{ACT}$ is the "H" level and then the switch transistor $Q_{P4}$ is in an OFF state. While the nonvolatile memory 13 is not operated, the memory activation signal $R_{ACT}$ is the "L" level and then the switch transistor $Q_{P4}$ is in an ON state.

Moreover, as in the second embodiment, the load adjustment section 32 adjusts a load of the current consumption control circuit 61 so that the amount of electric current which the current consumption control circuit 61 consumes is substantially the same as the amount of electric current which the nonvolatile memory 13 consumes.

In the fifth embodiment, as in the same manner as that of the second embodiment, a difference between the amount of electric current which the nonvolatile memory 13 consumes in an operation state and the amount of electric current which the current consumption control circuit 61 consumes in an operation state can be reliably adjusted.

(Sixth Embodiment)

Hereinafter, a semiconductor memory device according to a sixth embodiment of the present invention will be described with reference to the accompanying drawings.

Figure 6:
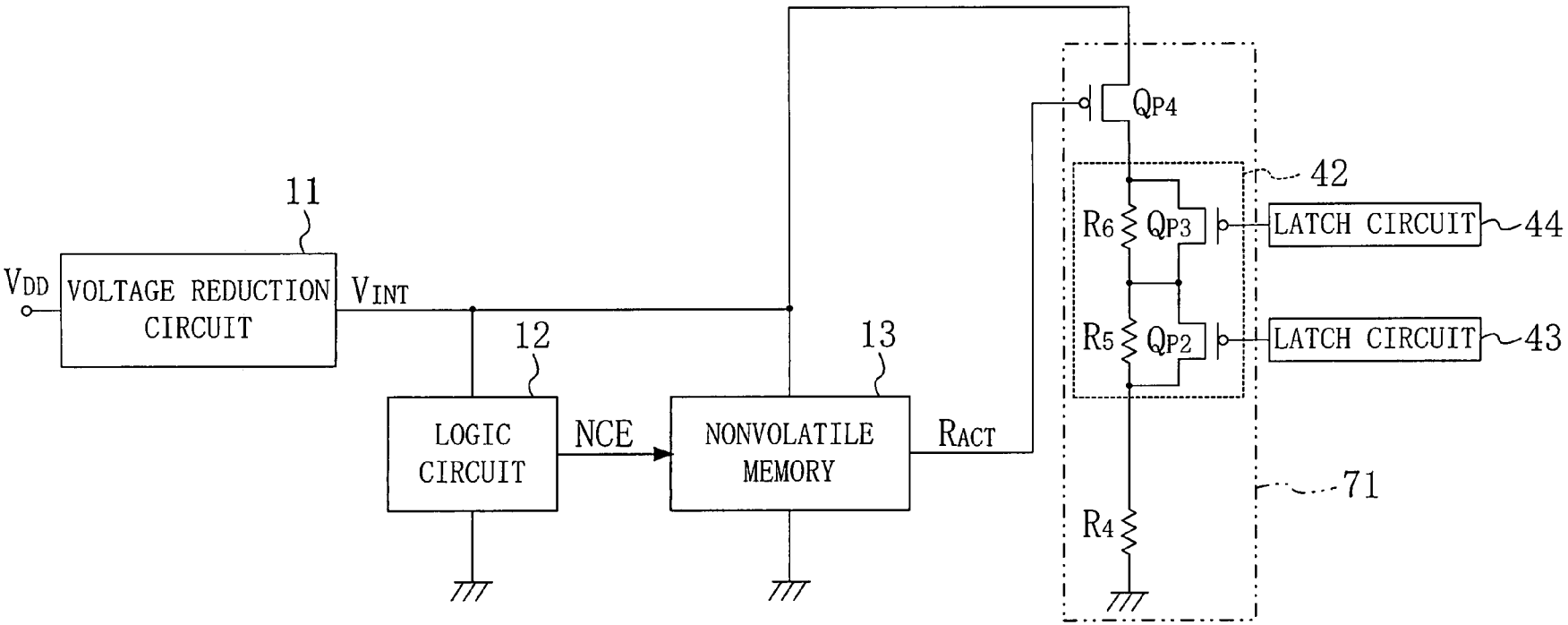
FIG. 6 is a block diagram illustrating the configuration of a semiconductor memory device according to a sixth embodiment of the present invention.

FIG. 6 is a block diagram illustrating the configuration of a semiconductor memory device according to the sixth embodiment. In FIG. 6, each member also shown in FIGS. 3 and 4 is identified by the same reference numeral, and therefore, description thereof will be omitted.

As shown in FIG. 6, a switch transistor $Q_{P4}$, a resistor $R_4$, and a load adjustment section 42 including resistors $R_5$ and $R_6$ connected in series to each other and p-channel transistors $Q_{P2}$ and $Q_{P3}$ connected in parallel to the resistors $R_5$ and $R_6$, respectively, are connected in series.

In this case, as in the fourth embodiment, while the nonvolatile memory 13 is operated, the memory activation signal $R_{ACT}$ is the "H" level and then the switch transistor $Q_{P4}$ is in an OFF state. While the nonvolatile memory 13 is not operated, the memory activation signal $R_{ACT}$ is the "L" level and then the switch transistor $Q_{P4}$ is in an ON state.

Moreover, the load adjustment section 42 writes correction data in the nonvolatile memory 13, thereby adjusting a load of the current consumption control circuit 71 so that the amount of electric current which the current consumption control circuit 71 is substantially the same as the amount of electric current which the nonvolatile memory 13 consumes.

In the sixth embodiment, as in the same manner as that of the third embodiment, a difference between the amount of electric current which the nonvolatile memory 13 consumes in an operation state and the amount of electric current which the current consumption control circuit 71 consumes in an operation state can be reliably adjusted.

(Seventh Embodiment)

Hereinafter, an IC card according to a seventh embodiment of the present invention will be described with reference to the accompanying drawings.

Figure 7:
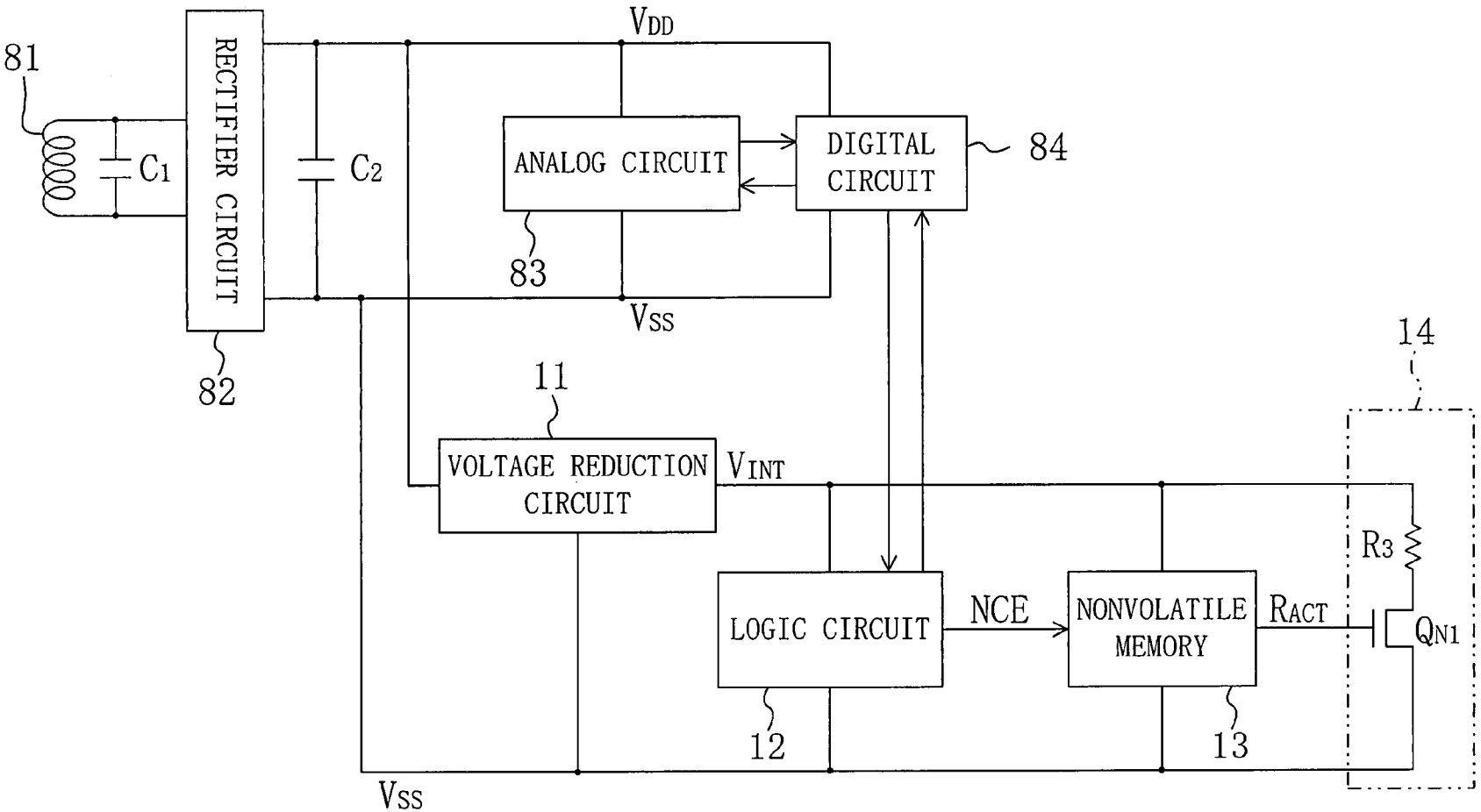
FIG. 7 is a block diagram illustrating the configuration of an IC card according to a seventh embodiment of the present invention.
Figure 8:
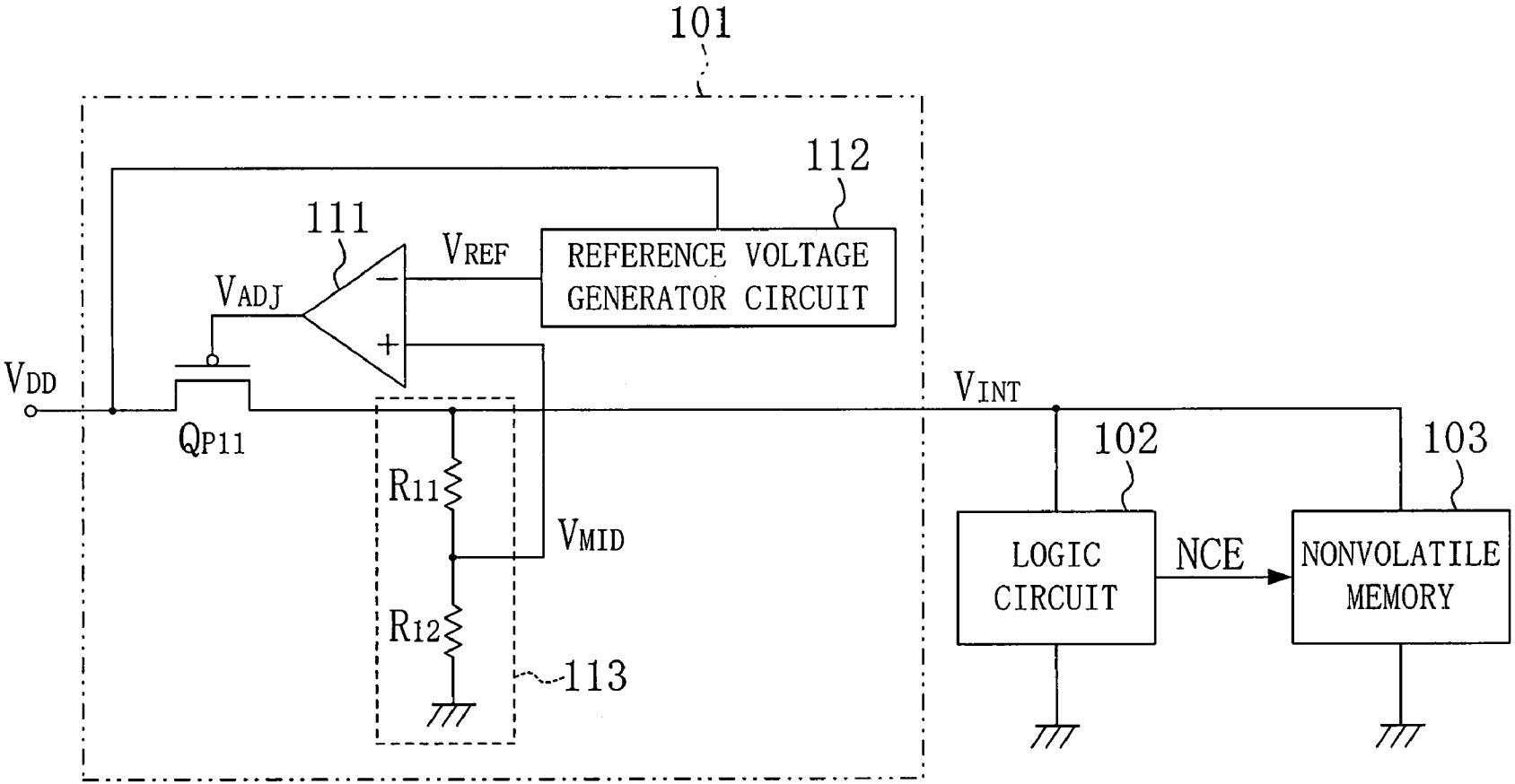
FIG. 8 PRIOR ART
FIG. 8 is a block diagram illustrating a semiconductor memory device according to a first known example.
Figure 9:
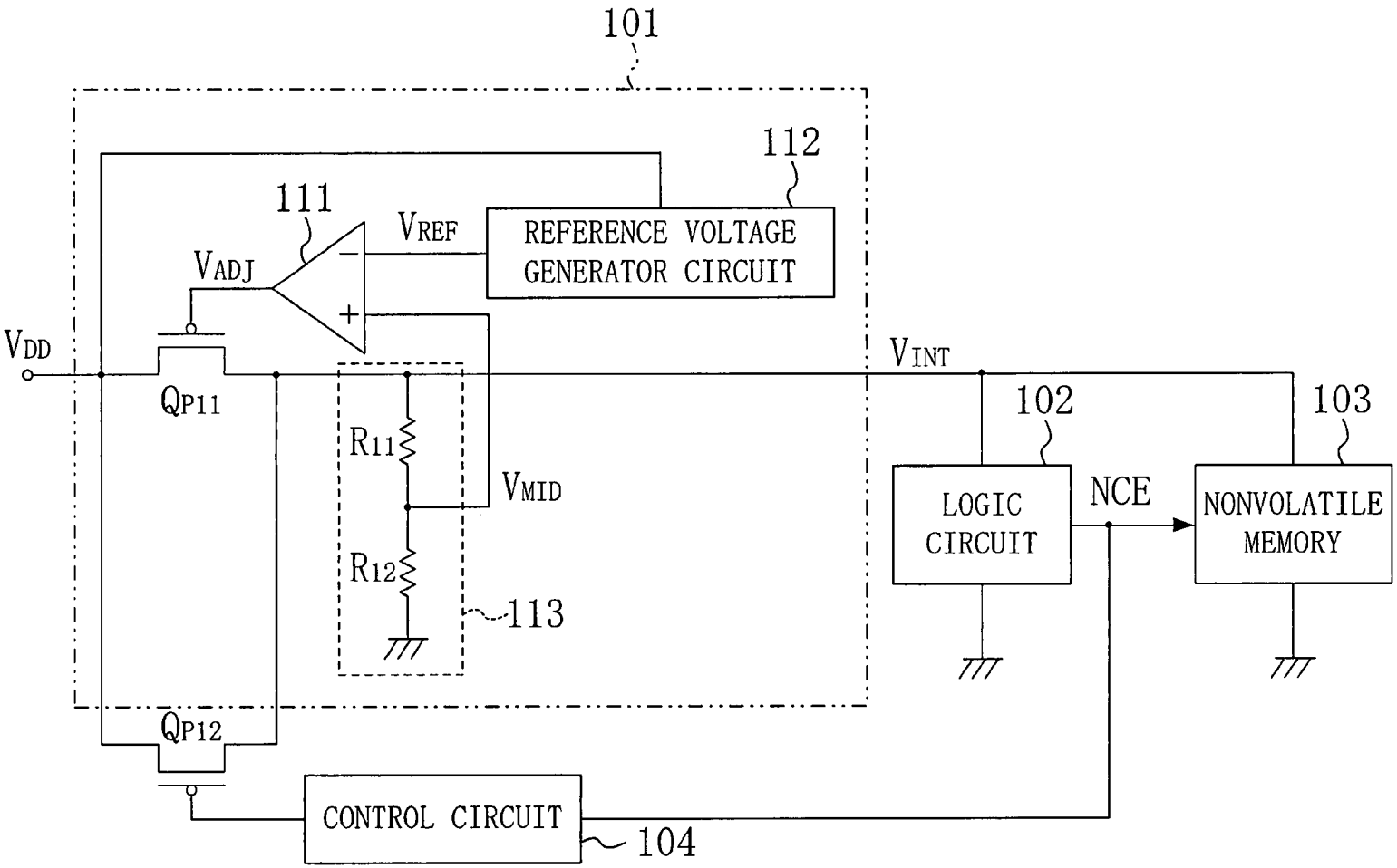
FIG. 9 PRIOR ART
FIG. 9 is a block diagram illustrating a semiconductor memory device according to a second known example.

FIG. 7 is a block diagram illustrating an IC card according to the seventh embodiment. in FIG. 7, each member also shown in FIG. 1 is identified by the same reference numeral, and therefore, description thereof will be omitted.

As shown in FIG. 7, an antenna coil 81 for receiving an electromagnetic wave from the outside, a resonance capacitance $C_1$ connected in parallel to the antenna coil 81 so as to resonate with the frequency of an electromagnetic wave, a rectifier circuit 82 for generating a power supply voltage $V_{DD}$ from an output of the antenna coil 81, and a smoothing capacitance $C_2$ are provided. The power supply voltage $V_{DD}$ is supplied to a voltage reduction circuit 11 as well as an analog circuit 83 and a digital circuit 84.

The power supply voltage $V_{DD}$ obtained via the antenna coil 81 has a larger voltage level than those of operation voltages of a nonvolatile memory 13 and a logic circuit 12 which controls the operation of the nonvolatile memory 13. Therefore, an internal voltage $V_{INT}$ obtained by reducing the power supply voltage $V_{DD}$ is supplied to the logic circuit 12 and the nonvolatile circuit 13 via the voltage reduction circuit 11.

An analog circuit 83 has the function of composing received data and a control signal input from the antenna coil 81 and the function of modulating transmission data and a control signal generated by the digital circuit 84 to a carrier wave of an electromagnetic wave. Moreover, the digital circuit 84 includes a CPU for processing a digital signal based on the control signal input from the antenna coil 81 via the analog circuit 83 and the like, and controls the operation of the logic circuit 12 based on the control signal input from the antenna coil 81 via the analog circuit 83.

In the IC card of the seventh embodiment, as in the first embodiment, a current consumption control circuit 14 including a switch transistor $Q_{N1}$ and a resistor $R_3$ is provided as a circuit for suppressing reduction in the potential of the internal voltage $V_{INT}$ due to the operation of the nonvolatile memory 13. The operation of the current consumption control circuit 14 is the same as that in the first embodiment, and therefore, description thereof will be omitted.

In the IC card of the seventh embodiment, the potential of the internal voltage $V_{INT}$ is not reduced even when the nonvolatile memory 13 is in an operation state, so that the internal voltage $V_{INT}$ can be stabilized. Specifically, in an IC card, since an area in which a semiconductor device can be loaded is limited, it has been difficult to use a capacitor with a large device area and a large capacity for suppressing reduction in the potential of the internal voltage $V_{INT}$ generated when an operation state of the nonvolatile memory 13 is changed to an operation state. However, with the current consumption circuit 14, increase in an layout area of an semiconductor device can be avoided.

Note that in the seventh embodiment, the current consumption control circuit of the first embodiment is used. However, any one of the current consumption control circuits of the second through sixth embodiments may be used.

What is claimed is:

1. A semiconductor device comprising:

an internal voltage supply circuit for generating an internal voltage from a power supply voltage;

an internal circuit which is operated by the internal voltage;

a switching transistor for receiving at a gate an operation signal output from the internal circuit; and a load circuit which is connected to a drain of the switching transistor and consumes substantially the same amount of electric current as the amount of electric current which the internal circuit consumes during an operation period, wherein by the operation signal, the switching transistor is turned OFF when the internal circuit is in an operation state and is turned ON when the internal circuit is in a non-operation state, and the load circuit includes a first resistor and a load adjustment section connected in series to the first resistor.

2. The semiconductor device of claim 1, wherein the amount of electric current which the first resistor and the load adjustment section consume is substantially the same as the amount of electric current which the internal circuit consumes during the operation period.

3. The semiconductor device of claim 2, wherein the load adjustment section includes a second resistor and a fuse device connected in parallel to each other.

4. The semiconductor device of claim 2, wherein the load adjustment section includes a second resistor and a transistor connected in parallel to each other.

5. The semiconductor device of claim 4, further comprising a latch circuit connected to the transistor.

6. The semiconductor device of claim 1, wherein the switching transistor is an n-channel transistor.

7. The semiconductor device of claim 6, wherein the switching transistor has a source grounded and the drain connected to the internal voltage supply circuit via the load circuit.

8. The semiconductor device of claim 1, wherein the switching transistor is a p-channel transistor.

9. The semiconductor device of claim 8, wherein the switching transistor has a source connected to the internal voltage supply circuit and the drain grounded via the load circuit.

10. An IC card comprising:

a semiconductor device which includes an internal voltage supply circuit for generating an internal voltage from a power supply voltage, an internal circuit which is operated by the internal voltage, a switching transistor for receiving at a gate an operation signal output from the internal circuit, and a load circuit which is connected to a drain of the switching transistor and consumes substantially the same amount of electric current as the amount of electric current which the internal circuit consumes during an operation period and in which by the operation signal, the switching transistor is turned OFF when the internal circuit is in an operation state and is turned ON when the internal circuit is in a non-operation state, wherein the load circuit includes a first resistor and a load adjustment section connected in series to the first resistor.

11. A semiconductor device comprising:

an internal voltage supply circuit for generating an internal voltage from a power supply voltage;

an internal circuit which is operated by the internal voltage;

a switching transistor for receiving at a gate an operation signal output from the internal circuit; and a load circuit which is connected to a drain of the switching transistor and consumes substantially the same amount of electric current as the amount of electric current which the internal circuit consumes during an operation period, wherein by the operation signal, the switching transistor is turned OFF when the internal circuit is in an operation state and is turned ON when the internal circuit is in a non-operation state, the load circuit includes a first resistor, and a load adjustment section for adjusting the amount of electric current which the load circuit consumes when the switching transistor is turned ON, the load adjustment section includes a second resistor and a fuse device which are connected in parallel to each other, and if the amount of electric current which the first resistor consumes is more than the amount of electric current which the internal circuit consumes during the operation period when the fuse device is not cut, the amount of electric current which the load circuit consumes is adjusted to be substantially the same as the amount of electric current which the internal circuit consumes by cutting the fuse device.

* * * * *